US008172112B2

(12) United States Patent
Karwacki, Jr.

(10) Patent No.: US 8,172,112 B2
(45) Date of Patent: May 8, 2012

(54) DEVICE FOR STAGING AND DISPENSING TABLETS USEFUL IN SYSTEM AND METHOD FOR DISPENSING PRESCRIPTIONS

(75) Inventor: Edward J. Karwacki, Jr., Garner, NC (US)

(73) Assignee: Parata Systems, LLC, Durham, NC (US)

( * ) Notice: Subject to any disclaimer, the term of this patent is extended or adjusted under 35 U.S.C. 154(b) by 944 days.

(21) Appl. No.: 12/187,574

(22) Filed: Aug. 7, 2008

(65) Prior Publication Data

US 2009/0039098 A1 Feb. 12, 2009

Related U.S. Application Data

(63) Continuation-in-part of application No. 12/186,025, filed on Aug. 5, 2008.

(60) Provisional application No. 60/955,056, filed on Aug. 10, 2007.

(51) Int. Cl.
*B67D 7/06* (2010.01)

(52) U.S. Cl. ..... 222/181.1; 222/185.1; 222/196; 222/197; 222/243; 222/523; 221/200

(58) Field of Classification Search ..... 222/1, 181.1, 222/196, 461, 185.1, 197, 198, 226, 242–243, 222/246–247, 522–523, 525, 502, 517–518, 222/544, 556, 559, 484; 221/200, 204, 208
See application file for complete search history.

(56) References Cited

U.S. PATENT DOCUMENTS

| | | | | | |
|---|---|---|---|---|---|
| 1,157,709 | A | * | 10/1915 | Maher | 111/35 |
| 1,445,078 | A | * | 2/1923 | Freeman | 222/77 |
| 1,718,084 | A | * | 6/1929 | Segelken | 222/523 |
| 1,783,423 | A | * | 12/1930 | Harper | 222/161 |
| 2,044,326 | A | * | 6/1936 | Pickell | 222/48 |
| 2,150,753 | A | * | 3/1939 | Weinstein | 222/517 |
| 3,089,620 | A | * | 5/1963 | Green et al. | 222/89 |
| 3,320,879 | A | * | 5/1967 | Edwards et al. | 101/335 |

(Continued)

OTHER PUBLICATIONS

Baker Cells® Brochure—Dispensing Technology: Industry Standard for Efficiency in Automated Prescription Filling, McKesson Pharmacy Systems and Automation, http://www.mckessonaps.com, Dated Apr. 27, 2005.

*Primary Examiner* — Frederick C. Nicolas
(74) *Attorney, Agent, or Firm* — Myers Bigel Sibley & Sajovec

(57) ABSTRACT

A chute assembly for a system configured to dispense objects from a bulk supply of such objects includes: an elongate chute having an open bottom end; a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages objects in the bottom end portion of the chute, and a dispensing position, in which the door moves away from the bottom end of the chute to enable objects staged in the bottom end portion of the chute to be dispensed from the chute; and an agitation unit coupled to the dispensing assembly, the agitation unit configured to impart energy to objects staged in the bottom end of the sleeve as the sleeve moves to the dispensing position.

22 Claims, 9 Drawing Sheets

U.S. PATENT DOCUMENTS 3,779,428 A * 12/1973 Bauman ..... 222/498
3,823,844 A 7/1974 Linkemer et al.
4,049,157 A * 9/1977 Carson ..... 222/81
4,384,662 A * 5/1983 Boudin et al. ..... 222/484
4,466,559 A * 8/1984 Loader ..... 222/196
4,619,379 A * 10/1986 Biehl ..... 222/153.14
5,317,645 A 5/1994 Perozek et al.
5,473,703 A 12/1995 Smith
5,647,508 A * 7/1997 Ronci et al. ..... 222/23
5,667,108 A * 9/1997 Braun et al. ..... 222/181.1
5,765,606 A 6/1998 Takemasa et al.
5,884,806 A 3/1999 Boyer et al.
5,907,493 A 5/1999 Boyer et al.
6,138,878 A * 10/2000 Savage et al. ..... 222/517
6,161,721 A 12/2000 Kudera et al.
6,370,215 B1 4/2002 Pinto et al.
6,481,180 B1 11/2002 Takahashi et al.
6,497,339 B1 12/2002 Geltser et al.
6,581,355 B1 6/2003 Yuyama et al.
6,595,384 B2 7/2003 Takahashi
6,644,504 B2 11/2003 Yuyama et al.
6,659,304 B2 12/2003 Geltser et al.
7,014,063 B2 3/2006 Shows et al.
7,073,544 B2 7/2006 Geltser et al.
7,178,697 B2 * 2/2007 Brundick et al. ..... 222/181.1
7,263,411 B2 8/2007 Shows et al.
7,334,700 B2 2/2008 Hatsuno et al.
7,412,302 B2 8/2008 Cobb et al.
7,770,355 B2 * 8/2010 Inamura ..... 53/131.5

* cited by examiner

DEVICE FOR STAGING AND DISPENSING TABLETS USEFUL IN SYSTEM AND METHOD FOR DISPENSING PRESCRIPTIONS

RELATED APPLICATIONS

This application is a Continuation-in-Part (CIP) of prior U.S. patent application Ser. No. 12/186,025, filed Aug. 5, 2008, and also claims priority from U.S. Provisional Patent Application No. 60/955,056, filed Aug. 10, 2007 for Device for Staging and Dispensing Tablets Useful in System and Method for Dispensing Prescriptions, the disclosure of each of which is hereby incorporated herein in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate all or portions of the pharmacy environment. Different exemplary approaches are shown in U.S. Pat. Nos. 6,006,946; 6,036,812 and 6,176,392 to Williams et al. and in U.S. Pat. No. 7,014,063 to Shows et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Shows et al. discloses a system that includes multiple drawers, each of which includes a plurality of dispensing devices that dispense tablets into a dispensing chute. The dispensing devices may be of the so-called "Baker Cell" configuration (see U.S. Pat. No. 3,368,713 to Hurst et al.), in which the tablets are mechanically singulated and counted prior to dispensing into the dispensing chute. The tablets are stored in the dispensing chute until such time as a pharmacist or technician dispenses the tablets from the chute into a pharmaceutical vial.

Although either of these particular systems can provide some automated steps to pharmaceutical dispensing, certain of the operations may be improved. In particular, tablets stored in the chute can jam, thereby rendering their dispensing into a waiting vial more difficult. Also, in some cases a pharmacy may desire some restrictions on the dispensing of the tablets from the chute.

SUMMARY OF THE INVENTION

As a first aspect, embodiments of the present invention are directed to a chute assembly for a system configured to dispense objects from a bulk supply of such objects. The chute assembly comprises: an elongate chute having an open bottom end; a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages objects in the bottom end portion of the chute, and a dispensing position, in which the door moves away from the bottom end of the chute to enable objects staged in the bottom end portion of the chute to be dispensed from the chute; and an agitation unit coupled to the dispensing assembly, the agitation unit configured to impart energy to objects staged in the bottom end of the sleeve as the sleeve moves to the dispensing position. The agitation unit can help to prevent the jamming of objects as they are dispensed.

As a second aspect, embodiments of the present invention are directed to a dispensing system, comprising: a bulk dispensing bin configured to hold a plurality of objects; and a chute assembly attached to the bin. The chute assembly comprises: an elongate chute having an upper end attached to and fed by the bulk dispensing bin and an open bottom end; a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages objects in the bottom end portion of the chute, and a dispensing position, in which the door moves away from the bottom end of the chute to enable objects staged in the bottom end portion of the chute to be dispensed from the chute; and an agitation unit coupled to the dispensing assembly, the agitation unit configured to impart energy to objects staged in the as the sleeve moves to the dispensing position.

As a third aspect, embodiments of the present invention are directed to a method of dispensing objects, comprising: providing a chute assembly in which a plurality of objects are staged, the chute assembly comprising: an elongate chute having an open bottom end; a dispensing unit slidably mounted to a bottom end portion of the chute, the dispensing unit including a sleeve that receives the bottom end portion of the chute and a door mounted thereto, the door covering the bottom end of the chute; and an agitation unit coupled to the dispensing unit; and sliding the sleeve relative to the chute to move the door to an open position away from the bottom end of the chute so that the objects can descend from the bottom end of the chute. Sliding the sleeve relative to the chute causes the agitation unit to impart energy to the objects as they descend, thereby assisting in the prevention of jamming of the objects.

DETAILED DESCRIPTION OF EMBODIMENTS OF THE INVENTION

Figure 1:
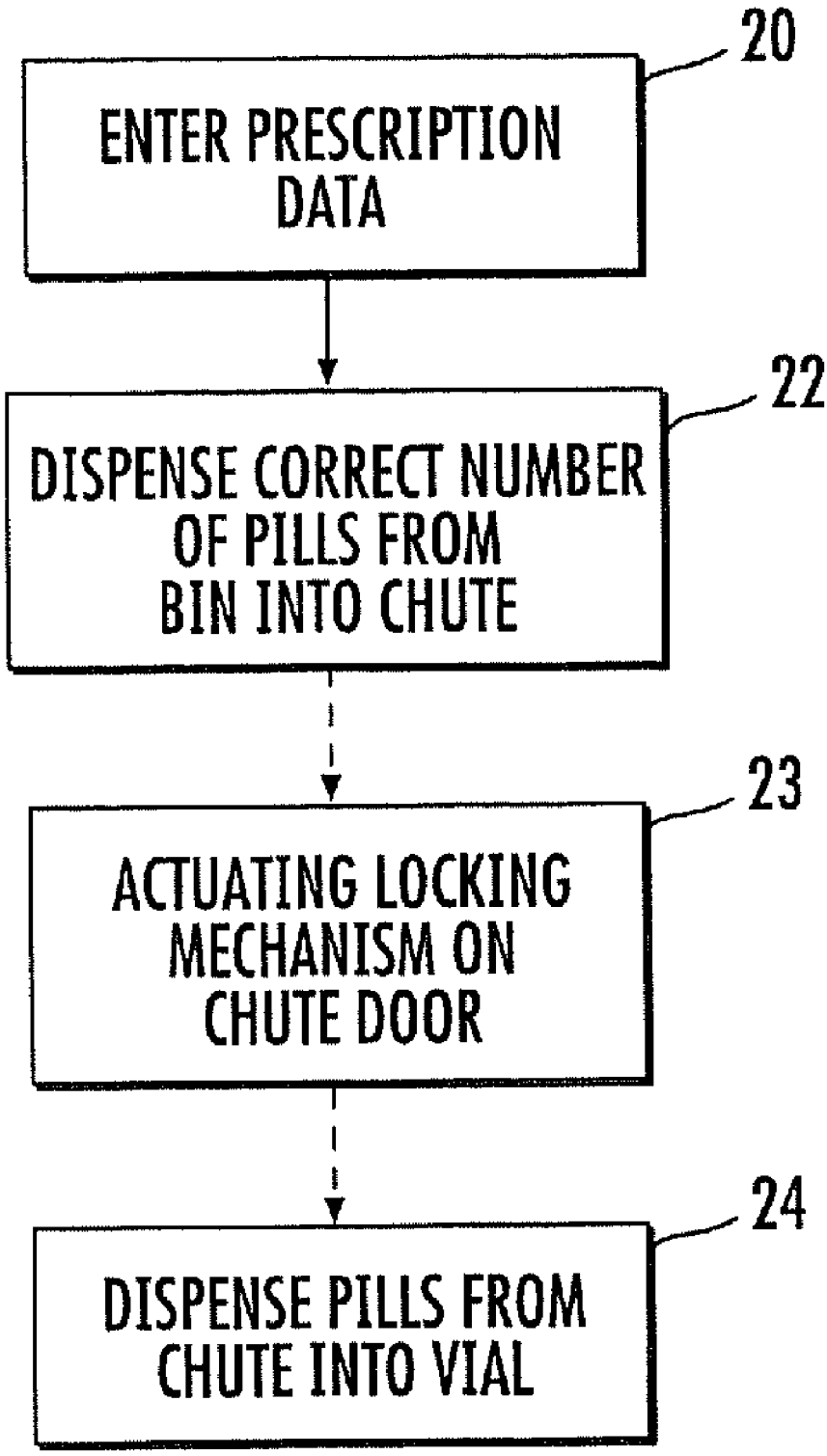
FIG. 1 is a flow chart of operations according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the entry of prescription data (Box 20). The correct number of pills to fill the prescription is dispensed from a bin containing a bulk supply of those pills into an attached chute (Box 22). The pills are then dispensed from the chute into a vial (Box 24), wherein the vial is typically held by pharmacy personnel. Optionally, the process may include a step in which a door of the chute is unlocked to release the pills from the chute (Box 23). Typically the unlocking of the chute occurs in response to an authorization or confirmation step, which may be initiated by the scanning of a user ID or a code on the vial.

Figure 3:
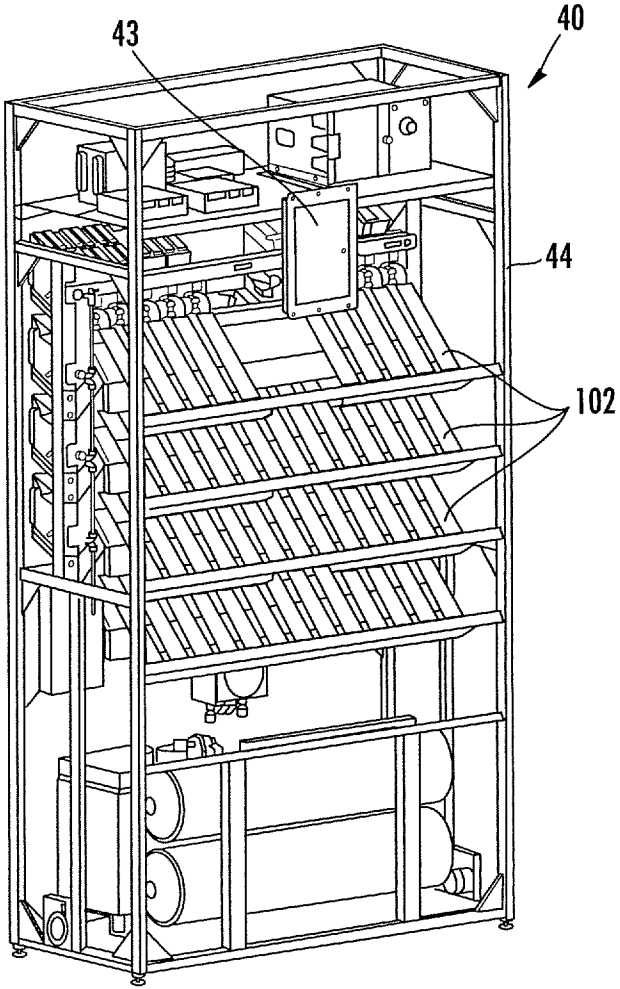
FIG. 3 is a reverse perspective view of the dispensing side (illustrating the chutes) of the pharmaceuticals dispensing system of FIG. 2.
Figure 2:
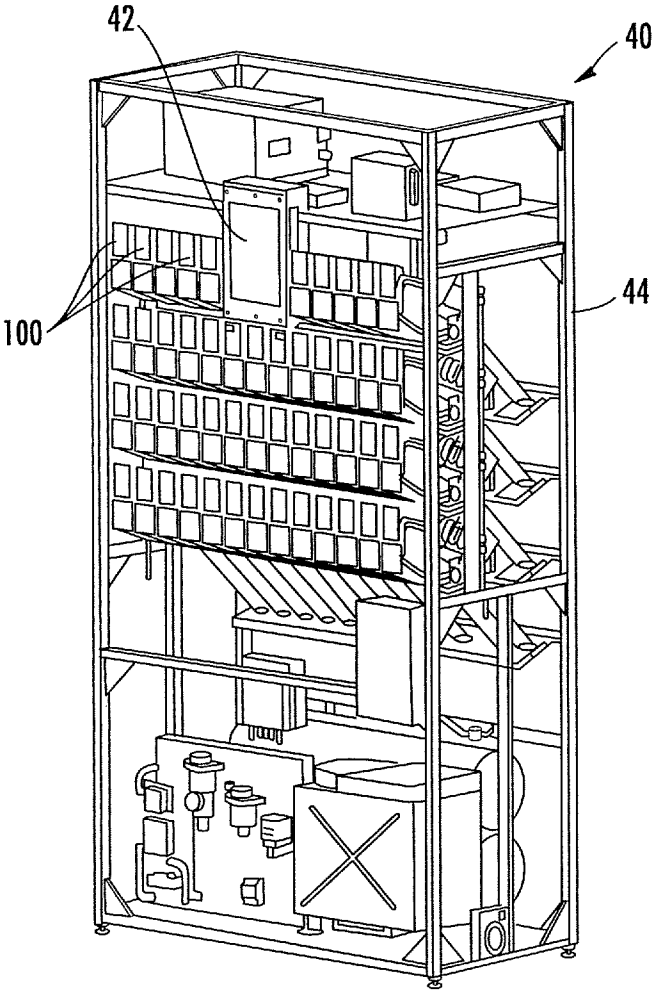
FIG. 2 is a perspective view of the replenishing side (illustrating the bins) of a pharmaceutical dispensing system according to embodiments of the present invention.

A system that can carry out this process is illustrated in FIGS. 2 and 3 and designated broadly therein at 40. The system 40 includes a support frame 44 for the mounting of its various components. The system 40 generally includes as operative stations a controller (represented herein by two graphics user interface monitors 42), a number of tablet dispensing bins 100, and a number of chute assemblies 110, each associated with a respective bin 100. An exemplary system is disclosed in U.S. patent application Ser. No. 12/187,666, filed Aug. 7, 2008, entitled SYSTEM AND METHOD FOR DISPENSING PRESCRIPTIONS, the disclosure of which is hereby incorporated herein in its entirety.

In the illustrated embodiment, the bins 100 are configured to singulate, count and dispense pills through an air agitation technique. The air agitation technique is described in some detail in, for example, U.S. Pat. No. 6,971,541 to Williams et al., supra, and U.S. Pat. No. 7,344,049 to Daniels et al., and need not be described in detail herein. Those skilled in this art will appreciate that other pill dispensing apparatus, including those that rely on mechanical singulating action (see, e.g., U.S. Pat. No. 7,014,063), may also be employed.

Turning now to FIGS. 4-7, the lower end of an exemplary chute assembly 110 is illustrated therein. The chute assembly 110 includes a chute 112, and a dispensing assembly 120. These components are discussed in greater detail below; the components will initially be described in the closed, or staging, position of the chute assembly 110, then will subsequently be described as they move to the open, or dispensing, position.

Figure 4:
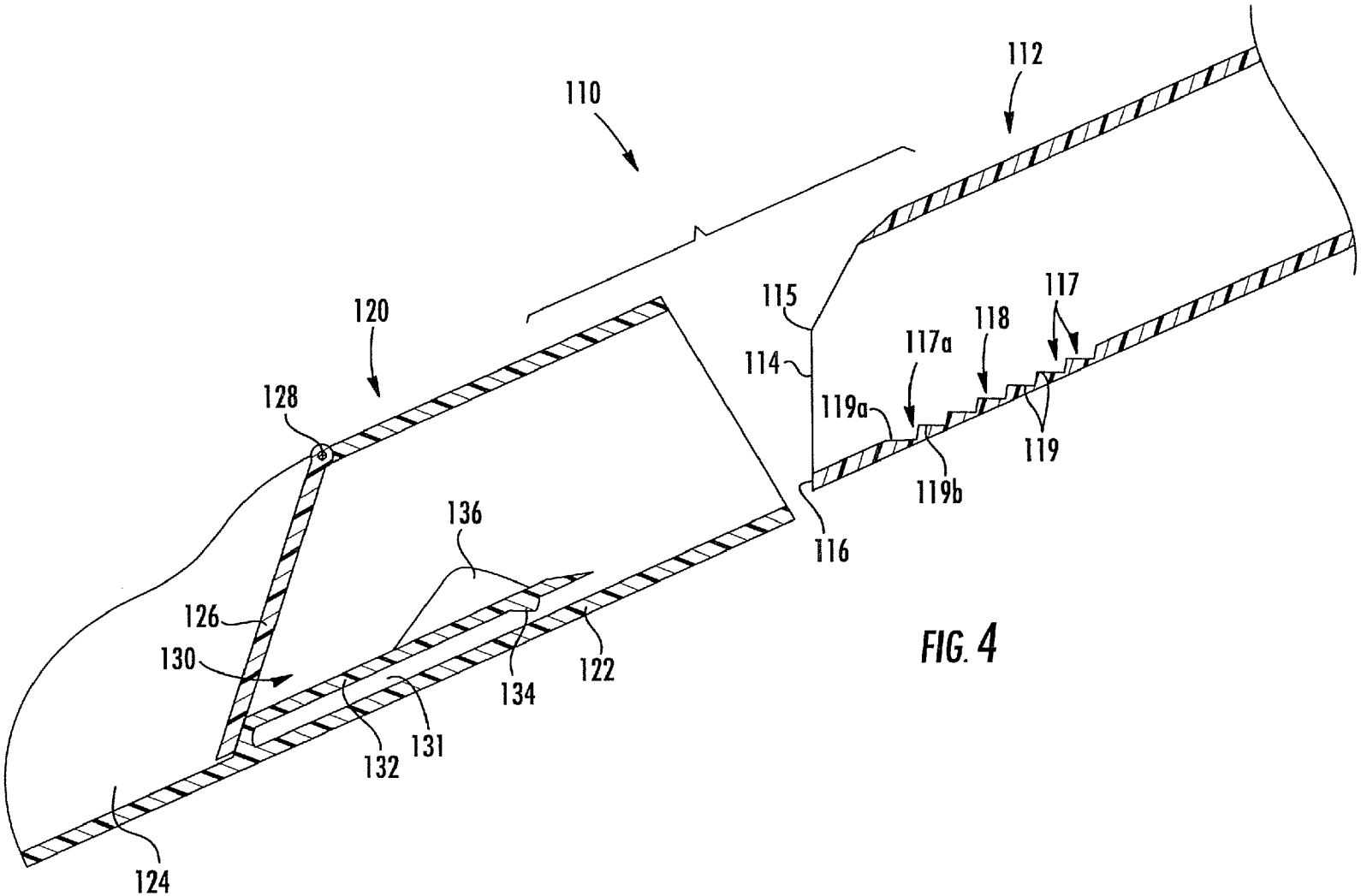
FIG. 4 is an exploded perspective view of a chute assembly for the system of FIGS. 2 and 3 according to embodiments of the present invention.

Turning first to FIG. 4, the chute 112 is an elongate hollow tube that extends downwardly from its associated bin 100. The chute 112 has a beveled front edge 114 that has a slight protrusion 115 and an edge 116 at its open lower end. A rack 118 that comprises teeth 119 separated by recesses 117 is located on the bottom inner surface of the chute 112 near the bottom edge 116.

The chute 112 can be formed of any suitable material, but is typically formed of a polymeric material such as polycarbonate. In some embodiments, the chute 112 is completely enclosed as illustrated herein, but need not be in other embodiments.

Referring still to FIG. 4, the dispensing assembly 120 includes a sleeve 122, the upper portion of which encircles the bottom end portion of the chute 112. A curved spout 124 extends from the lower end of the sleeve 122. A door 126 is attached via a hinge 128 to the end of the sleeve 122 and extends downwardly therefrom to cover the opening at the end of the chute 112.

Still referring to FIG. 4, an agitator 130 is attached to the inner surface of the sleeve 122. The agitator 130 comprises a plate 132 that is mounted in cantilever fashion over the lower end of the sleeve 122, thereby forming a gap 131 between the inner surface of the sleeve 122 and the lower surface of the plate 132 within which the lower edge 116 of the chute 112 resides (see FIG. 5). A nub 134 projects downwardly from the upper end of the plate 132 and, in the closed position of FIG. 5, resides in the recess 117*a* that is located between the lowermost two teeth 119*a*, 119*b* of the rack 118. A fin 136 extends upwardly from the upper surface of the plate 132.

Although the dispensing assembly 120 may be secured in position on the end of the chute 112 by the interaction of the nub 134 and the rack 118 alone, other structures, such as tabs, slots, sealing rings, and the like, may be included to capture the dispensing assembly 120 on the lower end of the chute 112.

The dispensing assembly 120 can be formed of any suitable material, but in some embodiments is formed of a polymeric material. The agitator 130 may be a separate component, or may be formed integrally with the sleeve 120 as shown.

Figure 5:
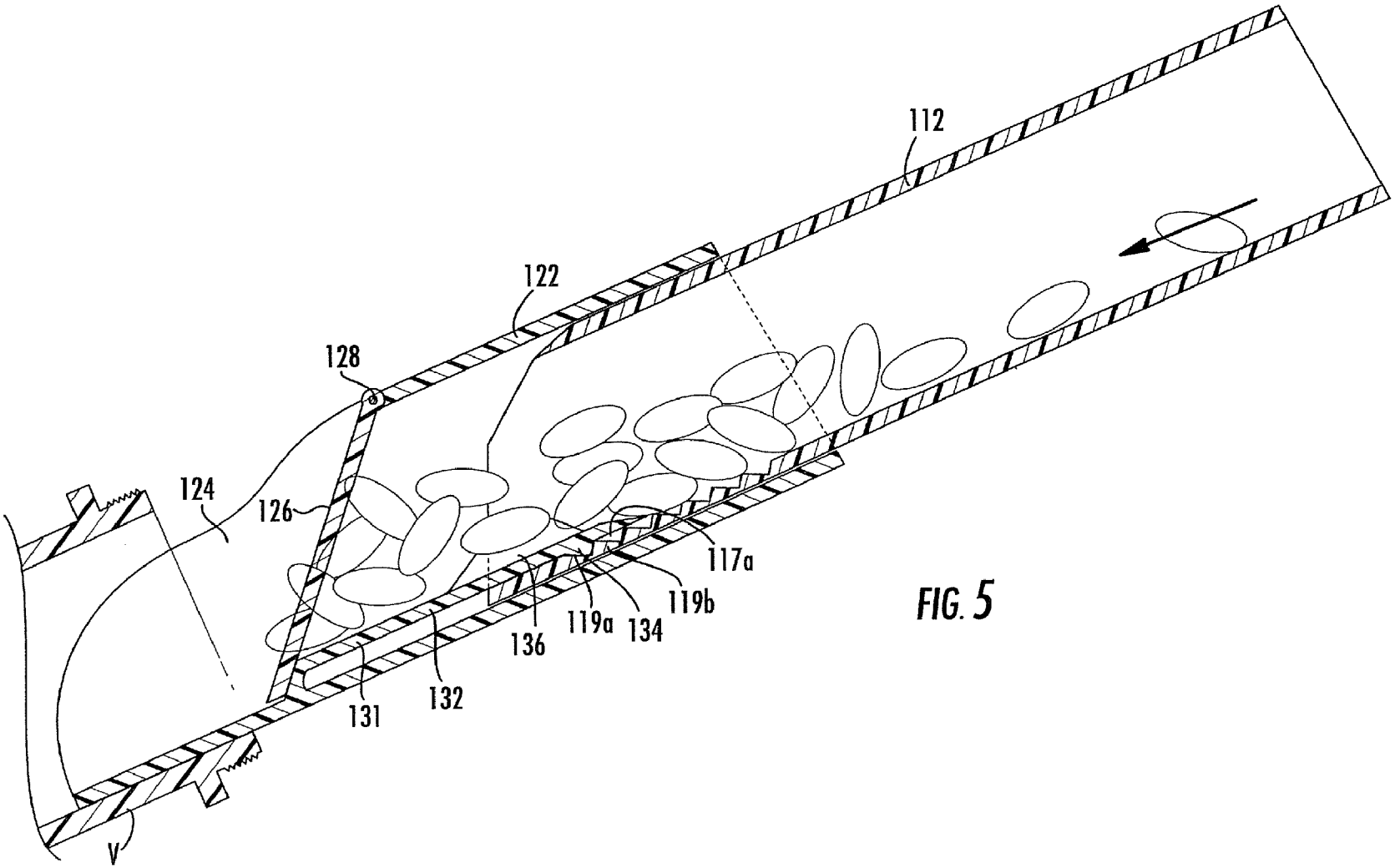
FIG. 5 is a side view of the chute assembly of FIG. 4 shown in its closed, or staging, position.
Figure 6:
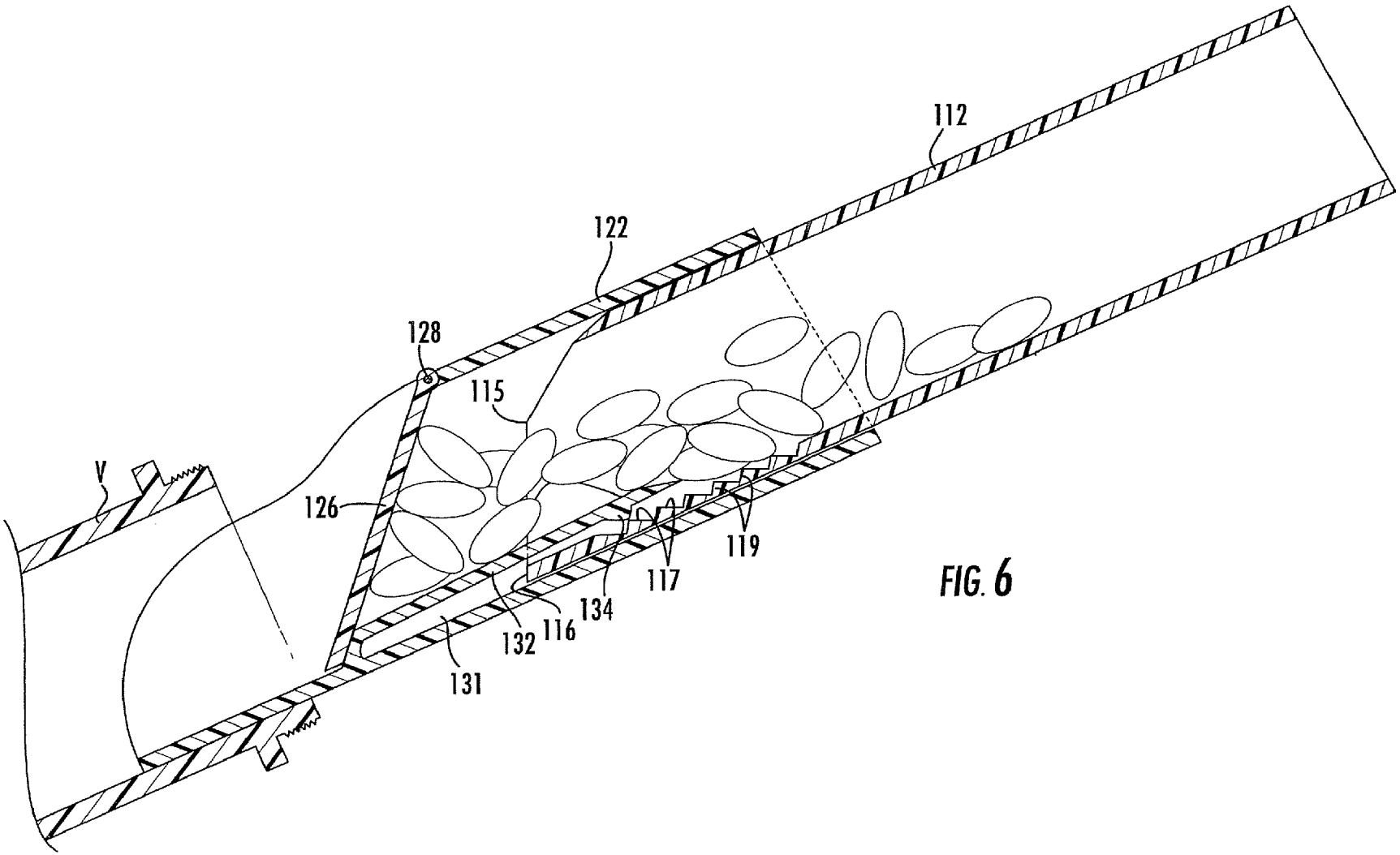
FIG. 6 is a side view of the chute assembly of FIG. 4 shown in an intermediate position in which the agitator agitates pills as they are dispensed.
Figure 7:
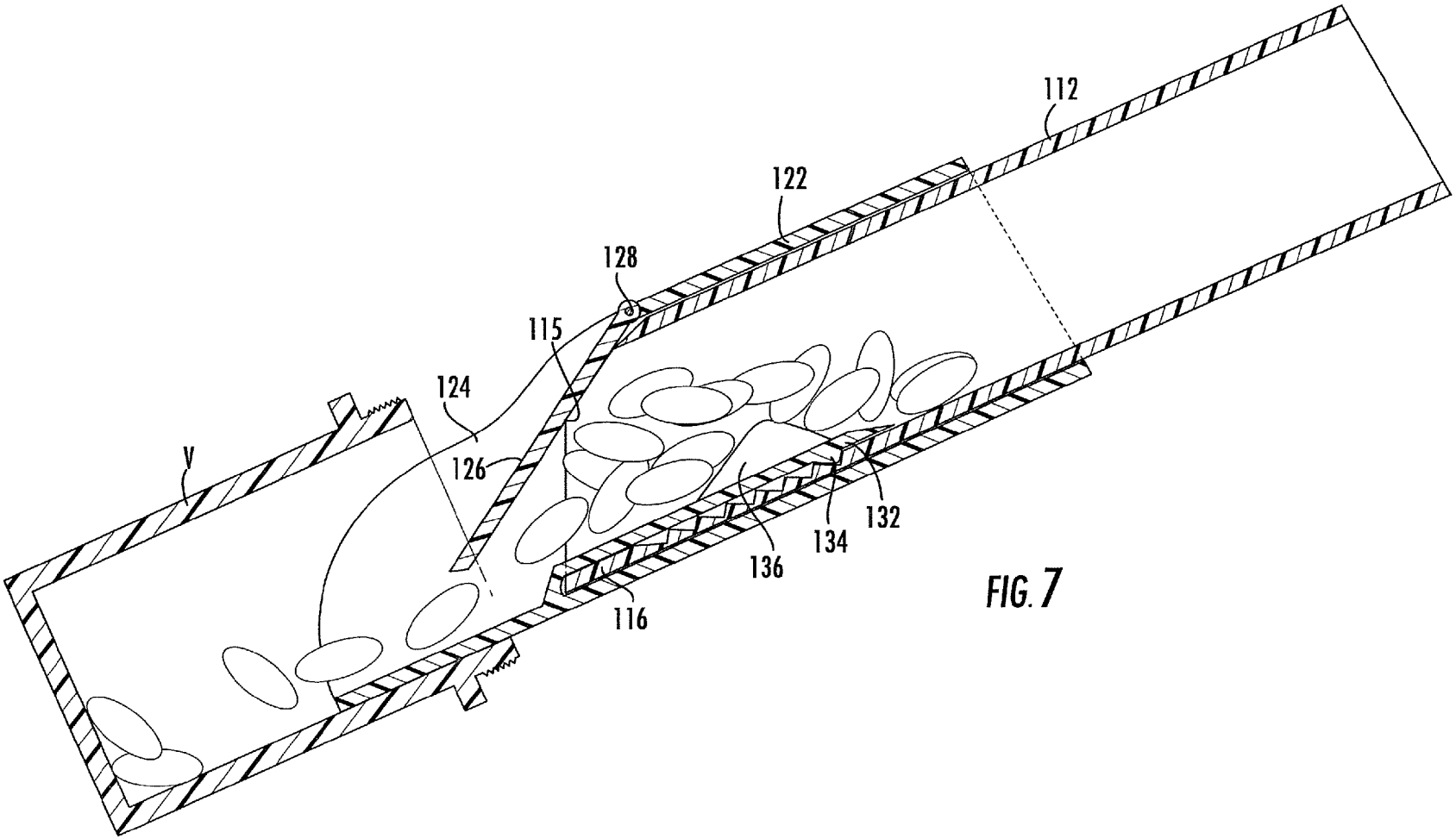
FIG. 7 is a side view of the chute assembly of FIG. 4 shown in its open position.

In operation, pills are dispensed from a bin 100 into one of the chutes 112 and slide to the bottom end of the chute 112, where they are staged within the cavity formed by the door 126 and the walls of the sleeve 122 and/or the chute 112 (see FIG. 5). The door 126 is maintained in position by gravity, but may also be biased toward the closed position via spring-loading or the like. When an operator wishes to dispense the pills into a vial V, he positions the vial V to be fed by the spout and pushes the vial V upwardly (i.e., along the longitudinal axis of the chute 112). This action forces the sleeve 122 upwardly relative to the chute 112. As is shown in FIGS. 5 and 6, as the sleeve 122 moves upwardly, the door 126 eventually contacts the protrusion 115 of the front edge 114 of the chute 112. Additional upward movement of the sleeve 122 induces the door 126 to pivot upwardly about the hinge 128, which opens the lower end of the cavity holding the staged pills and allows the pills to slide down the spout 124 and into the vial V (see FIG. 7).

As can be seen in FIG. 5, as the sleeve 122 advances upwardly, the nub 134 slides along the contour formed by the teeth 119 and recesses 117 of the rack 118. The rising and falling action of the nub 134 as it interacts with the rack 118 causes the plate 132 to alternately deflect away from, then recover toward, the rack 118. This vibratory movement of the plate 132 can help to prevent the jamming of pills as they slide down the chute 112, the sleeve 122 and the spout 124 into the vial or can help to dislodge jams that might occur when pills are staged prior to the movement of the sleeve 122.

Figure 8:
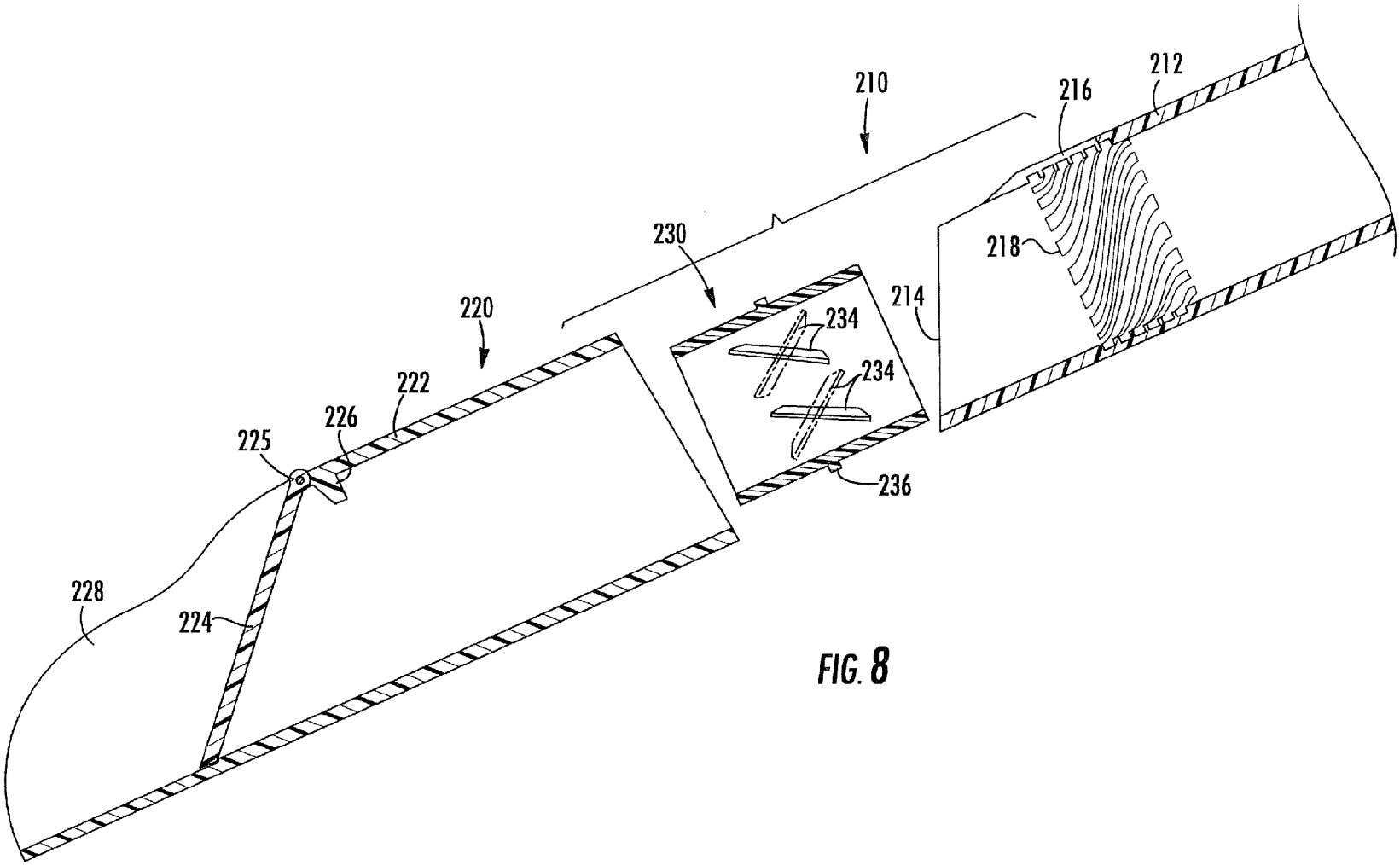
FIG. 8 is an exploded perspective view of a chute assembly for the system of FIGS. 2 and 3 according to alternative embodiments of the present invention.
Figure 9:
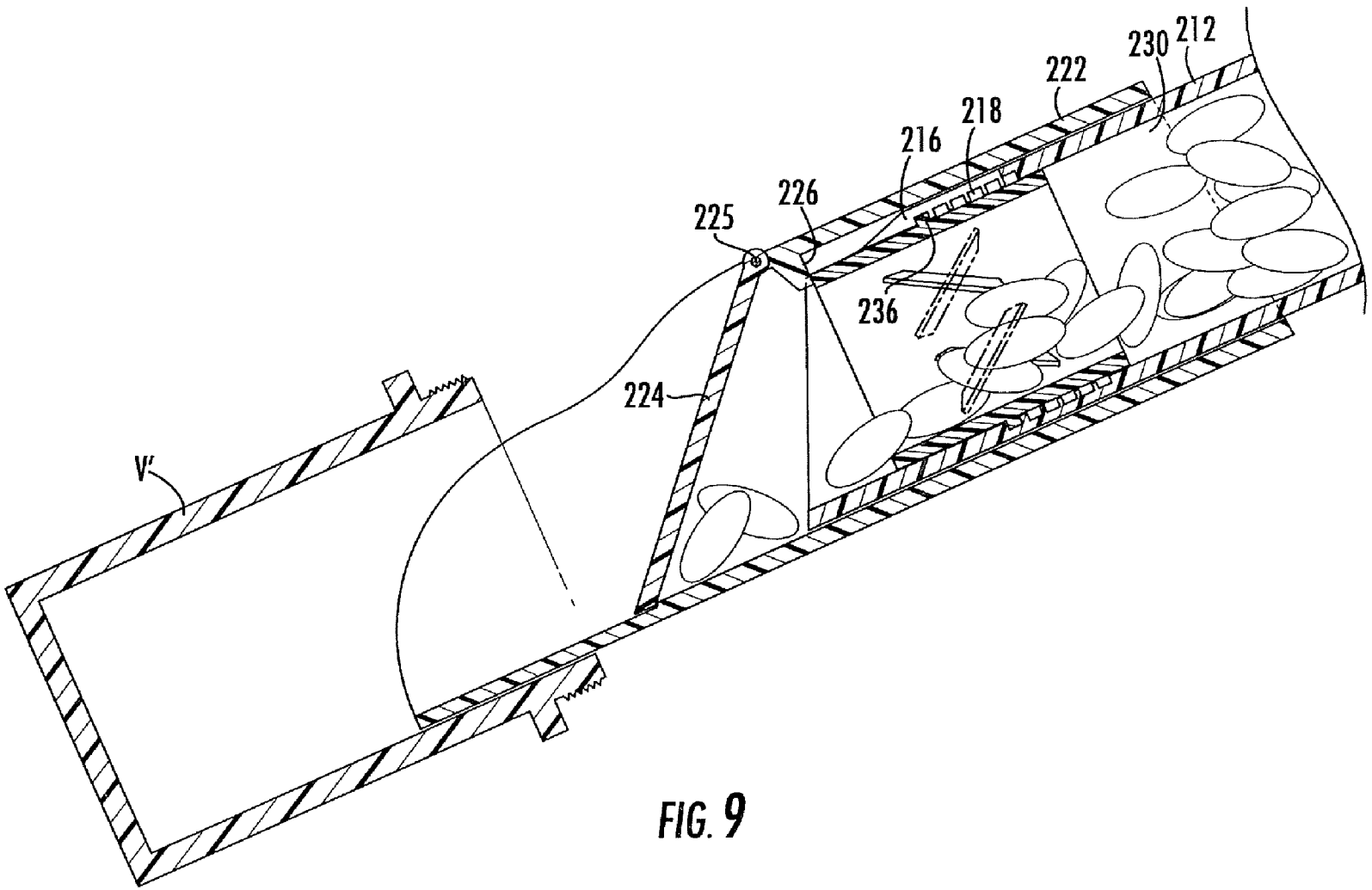
FIG. 9 is a side view of the chute assembly of FIG. 8 shown in its closed, or staging position.
Figure 10:
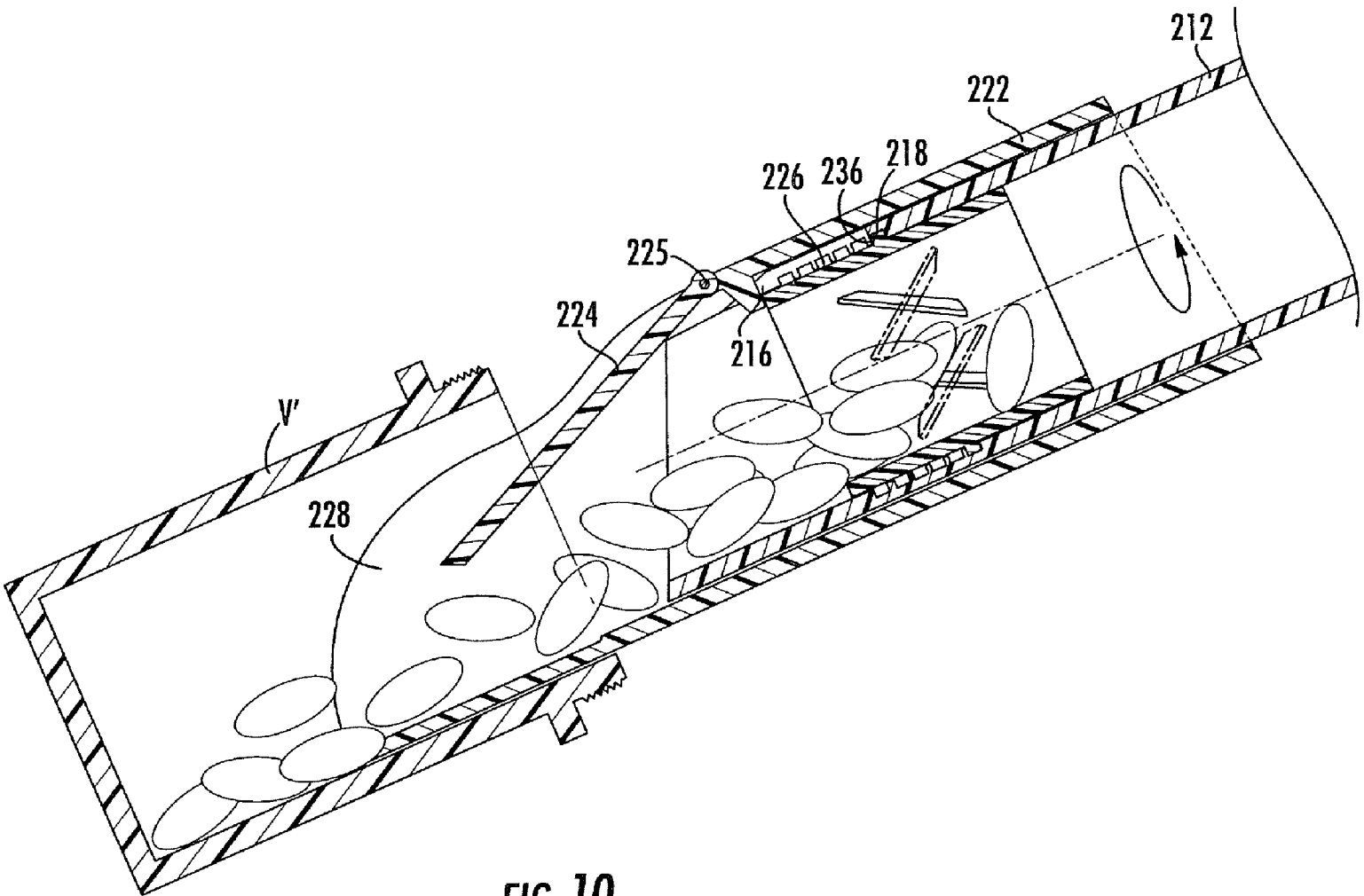
FIG. 10 is a side view of the chute assembly of FIG. 8 shown in its open position, wherein the agitator barrel has rotated to agitate pills as they are dispensed.

An alternative embodiment of a chute assembly is illustrated in FIGS. 8-10 and designated broadly at 210. This embodiment includes a chute 212 with a sloping front edge 214. An open-ended slot 216 is located on the top portion of the lower end of the chute 212. Also, as seen in FIG. 8, a helical toothed rack 218 is positioned around the inner surface of the lower end of the chute 212. As used herein, the term "helical" means that the teeth and recesses of the rack 218 extend circumferentially about the surface of the chute 212 with varying axial location; the term is intended to include both teeth that extend over a full revolution or more about the chute 212 and teeth that extend over only a partial revolution.

A dispensing assembly 220 includes a sleeve 222 and an agitator barrel 230. The sleeve 222 includes a downwardly-extending tooth 226 that fits within the open-ended slot 216 of the chute 212. A door 224 is attached to an upper portion of the sleeve 222 near the tooth 226 at a hinge 225. A dispensing spout 228 is attached to the lower end of the sleeve 222.

The agitator barrel 230 fits inside the inner surface of the chute 212. The agitator barrel 230 is hollow and includes an external ring of teeth 236 that mesh with the teeth of the rack 218 of the chute 212 (see FIG. 9). The lower end of the agitator barrel 230 rests against the tooth 226 of the sleeve 222. Four fins 234 extend radially inwardly from the inner surface of the agitator barrel 230.

The materials of the chute 212 and the dispensing assembly 220 can be as described above with respect to the chute 112 and the dispensing assembly 120 illustrated in FIGS. 4-7.

In the closed position depicted in FIG. 9, the agitator barrel 230 rests against the tooth 226, such that the teeth 236 are positioned at the lower end of the helical rack 218 and mesh with the teeth thereof. In this position, the door 224, biased by gravity or, in the alternative, a spring-loaded or other biasing mechanism, rests against the lower end of the sleeve 222 and covers the opening therein. The door 224, the lower portion of the sleeve 222 and the agitator barrel 230 form a cavity in which pills dispensed from a bin 100 can be staged.

When an operator wishes to dispense staged pills from the chute assembly 210, the operator positions a vial V' at the spout 228 and pushes upwardly along the longitudinal axis of the chute 212. This movement forces the sleeve 222 to slide upwardly relative to the chute 212. As the sleeve 222 slides upwardly, the door 224 strikes the lower end of the chute 212, which forces the door 224 to pivot about the hinge 225. The pivoting of the door 224 enables pills staged in the staging cavity to slide down the chute 212 and the spout 228 into the vial V'.

It can be seen in FIG. 10 that as the sleeve 222 slides relative to the chute 212, the tooth 226 moves upwardly in the slot 216. This action drives the agitator barrel 230 upwardly also. As the agitator barrel 230 slides upwardly inside the chute 212, the interaction between the teeth 236 and the teeth of the helical rack 218 induces the barrel 230 to rotate about the longitudinal axis of the chute 212. The rotation of the barrel 230, and in particular the rotation of the fins 234, can help to break up any jams in the pills that might form when the pills are staged.

Those skilled in this art will appreciate that other agitation units may also be employed. For example, more or fewer fins (or even no fins) may be included with either the agitator 130 or the agitator barrel 230. Agitation energy may be imparted to the pills via rotation of an outer sleeve or the like (as is shown in U.S. Provisional Patent Application No. 60/955,059, filed Aug. 10, 2007, and U.S. patent application Ser. No. 12/185,981, filed Aug. 5, 2008, the disclosures of each of which are hereby incorporated herein) rather than through translation of the sleeve relative to the chute. Other forms of agitation units may also be suitable.

Those skilled in this art also will appreciate that the design and/or locations of the teeth 236 and the toothed rack 218 can be varied in numerous ways provided that the teeth 236 and toothed rack 218 are able to interact and induce the barrel 230 to rotate. For example, the teeth 236 may be positioned around the inner surface of the lower end of the chute 212 and the toothed rack 218 may be located on the external surface of the agitator barrel 230.

In addition, although the doors 126, 224 are illustrated as being opened via interaction with the bottom end portion of the chute, the door may be opened via contact with another portion of the chute or with another component. Also, in some embodiments, the door may include a lock that must be disabled prior to the door being opened.

Those skilled in this art will appreciate that the dispensing stages of the present invention may also be employed with the dispensing of objects other than pharmaceutical tablets. For example, small component parts in a manufacturing line, dispensable candies, and the like may be dispensed with the stages of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A chute assembly for a system configured to dispense objects from a bulk supply of the objects, comprising:

an elongate chute having an open bottom end;

a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages at least a portion of the objects in the bottom end portion of the chute, and a dispensing position, in which the door moves away from the bottom end of the chute to enable the objects staged in the bottom end portion of the chute to be dispensed from the chute, wherein contact between the door and the bottom end portion of the chute moves the door away from the bottom end of the chute; and an agitation unit coupled to the dispensing assembly, the agitation unit configured to impart energy to the objects staged in the bottom end portion of the chute as the sleeve moves to the dispensing position.

2. The chute assembly defined in claim 1, wherein the sleeve slides substantially parallel to a longitudinal axis of the chute.

3. The chute assembly defined in claim 1, wherein the agitation unit comprises a toothed rack.

4. The chute assembly defined in claim 3, wherein the toothed rack is located on an inner surface of the chute.

5. The chute assembly defined in claim 4, wherein the agitation unit further comprises a member mounted to the dispensing assembly that extends within the open bottom end of the chute and a nub mounted on the member that interacts with the toothed rack as the sleeve moves from the staging position to the dispensing position, the interaction between the nub and the toothed rack causing the member to alternately deflect and recover.

6. The chute assembly defined in claim 3, wherein the agitation unit further comprises an agitation barrel received in the bottom end of the chute, the agitation barrel including teeth that interact with the toothed rack.

7. The chute assembly defined in claim 6, wherein the toothed rack includes helical teeth, and wherein interaction between the agitation barrel teeth and the toothed rack teeth rotates the agitation barrel about an axis substantially parallel to a longitudinal axis of the chute.

8. The chute assembly defined in claim 6, wherein the sleeve includes a projection that contacts the agitation barrel and forces the agitation barrel to translate relative to the chute as the sleeve translates relative to the chute.

9. The chute assembly defined in claim 1, wherein the agitation unit comprises at least one fin that extends radially inwardly.

10. The chute assembly defined in claim 1, wherein the door is pivotally mounted to the sleeve.

11. A chute assembly for a system configured to dispense objects from a bulk supply of the objects, comprising:

an elongate chute having an open bottom end;

a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages at least a portion of the objects in the bottom end portion of the chute, and a dispensing position, in which the door moves away from the bottom end of the chute to enable the objects staged in the bottom end portion of the chute to be dispensed from the chute, wherein the door is pivotally mounted to the sleeve; and an agitation unit coupled to the dispensing assembly, the agitation unit configured to impart energy to the objects staged in the bottom end portion of the chute as the sleeve moves to the dispensing position.

12. A dispensing system, comprising:

a bulk dispensing bin configured to hold a plurality of objects; and a chute assembly attached to the bin, comprising:

an elongate chute having an upper end attached to and fed by the bulk dispensing bin and an open bottom end;

a dispensing assembly slidably mounted to a bottom end portion of the chute, the dispensing assembly including a sleeve that receives the bottom end portion of the chute and a door pivotally mounted thereto, the sleeve being slidable between a staging position, in which the door covers the bottom end of the chute and thereby stages at least a portion of the objects in the bottom end portion of the chute, and a dispensing position, in which the door moves away from the bottom end of the chute to enable the objects staged in the bottom end portion of the chute to be dispensed from the chute; and an agitation unit coupled to the dispensing assembly, the agitation unit configured to impart energy to the objects staged in the bottom end portion of the chute as the sleeve moves to the dispensing position.

13. The dispensing system defined in claim 12, wherein the sleeve slides substantially parallel to a longitudinal axis of the chute.

14. The dispensing system defined in claim 12, wherein the agitation unit comprises a toothed rack.

15. The dispensing system defined in claim 14, wherein the toothed rack is located on an inner surface of the chute.

16. The dispensing system defined in claim 15, wherein the agitation unit further comprises a member mounted to the dispensing assembly that extends within the open bottom end of the chute and a nub mounted on the member that interacts with the toothed rack as the sleeve moves from the staging position to the dispensing position, the interaction between the nub and the toothed rack causing the member to alternately deflect and recover.

17. The dispensing system defined in claim 14, wherein the agitation unit further comprises an agitation barrel received in the bottom end of the chute, the agitation barrel including teeth that interact with the toothed rack.

18. The dispensing system defined in claim 17, wherein the toothed rack includes helical teeth, and wherein interaction between the agitation barrel teeth and the toothed rack teeth rotates the agitation barrel about an axis substantially parallel to a longitudinal axis of the chute.

19. The dispensing system defined in claim 17, wherein the sleeve includes a projection that contacts the agitation barrel and forces the agitation barrel to translate relative to the chute as the sleeve translates relative to the chute.

20. The dispensing system defined in claim 12, wherein the agitation unit comprises at least one fin that extends radially inwardly.

21. The dispensing system defined in claim 12, wherein contact between the door and the bottom end portion of the chute moves the door away from the bottom end of the chute.

22. A dispensing system, comprising:

a bulk dispensing bin configured to hold a plurality of objects; and a chute assembly attached to the bin, comprising:

an elongate chute having an upper end attached to and fed by the bulk dispensing bin and an open bottom end;

a dispensing assembly slidably mounted to a bottom end portion of the chute, the dispensing assembly including a sleeve that receives the bottom end portion of the chute and a door mounted thereto, the sleeve being slidable between a staging position, in which the door covers the bottom end of the chute and thereby stages at least a portion of the objects in the bottom end portion of the chute, and a dispensing position, in which the door moves away from the bottom end of the chute to enable the objects staged in the bottom end portion of the chute to be dispensed from the chute, wherein contact between the door and the bottom end portion of the chute moves the door away from the bottom end of the chute; and an agitation unit coupled to the dispensing assembly, the agitation unit configured to impart energy to objects staged in the bottom end portion of the chute as the sleeve moves to the dispensing position.

* * * * *